US006767603B1

(12) United States Patent
Hurst et al.

(10) Patent No.: US 6,767,603 B1
(45) Date of Patent: Jul. 27, 2004

(54) DISSIPATION OF STATIC ELECTRICITY IN WORKWEAR

(76) Inventors: Norman John Alfred Hurst, 12 Chapel Lane, Toynton-all-Saints, Spilsby, Lincolnshire (GB), PE23 5AF; Michelle Sharon Barker, 10 Morris Gardens, Skegness, Lincolnshire (GB), PE25 25Q ( * ) Notice: Subject to any disclaimer, the term of this patent is extended or adjusted under 35 U.S.C. 154(b) by 0 days.

(21) Appl. No.: 09/622,706

(22) PCT Filed: Feb. 26, 1999

(86) PCT No.: PCT/GB99/00595

§ 371 (c)(1),
(2), (4) Date: Aug. 21, 2000

(87) PCT Pub. No.: WO99/43224

PCT Pub. Date: Sep. 2, 1999

(30) Foreign Application Priority Data

Feb. 26, 1998 (GB) ..... 9803927

(51) Int. Cl.[7] ..... H05F 3/00; H01H 47/00; B29D 22/00

(52) U.S. Cl. ..... 428/36.1; 2/69; 2/902; 361/212; 361/220; 361/223; 361/224

(58) Field of Search ..... 428/36.1; 2/69, 2/902; 361/212, 220, 223, 224

(56) References Cited

U.S. PATENT DOCUMENTS 3,422,460 A * 1/1969 Burke et al. ..... 139/425 R
3,699,590 A * 10/1972 Webber et al. ..... 139/425 R
3,986,530 A * 10/1976 Maekawa ..... 139/425 R
4,422,483 A * 12/1983 Zins ..... 139/420 R
4,546,497 A * 10/1985 Ono et al. ..... 112/418
4,596,053 A * 6/1986 Cohen et al. ..... 2/51
4,753,088 A * 6/1988 Harrison et al. ..... 2/125
5,802,607 A * 9/1998 Triplette ..... 139/420 A
5,960,475 A * 10/1999 Fewtrell ..... 2/457
5,991,922 A * 11/1999 Banks ..... 2/69
6,302,993 B1 * 10/2001 Smith et al. ..... 156/108

* cited by examiner

*Primary Examiner*—Terrel Morris
*Assistant Examiner*—Lynda Salvatore
(74) *Attorney, Agent, or Firm*—Watov & Kipnes, P.C.; Kenneth Watov

(57) ABSTRACT

An article of workwear comprises a plurality of components (17,18) incorporating electrically conductive fibres (21), and an electrically conductive member (20) bridging the junction between adjacent components. The electrically conductive member comprises a strip or tape (20) incorporating a plurality of electrically conductive filaments or yarns (22), each filament or yarn being incorporated in the strip or tape in such a manner as to have alternate portions of the filament or yarn exposed at opposite faces of the strip or tape. The strip or tape may be secured to each of the adjacent components by stitching (19).

13 Claims, 7 Drawing Sheets

DISSIPATION OF STATIC ELECTRICITY IN WORKWEAR

FIELD OF THE INVENTION

This invention relates to the dissipation of static electricity in specialised workwear and more particularly to antistatic workwear, that is clothing or other garments worn for work.

BACKGROUND TO THE INVENTION

As electronic components become smaller and more sensitive they may be easily damaged by static electrical charges. It is therefore important that operatives engaged in the manufacture of such components are at earth potential, that is they do not carry a static electrical charge. For this purpose specialised workwear, for use in the micro electronics industry, has been developed made from tightly woven fabric incorporating a grid or stripe of electrically conductive yarn. This is designed to dissipate static electrical charges which would otherwise build-up as the article of workwear is worn. In particularly sensitive situations static dissipation is improved by earthing the operator, the workwear or both.

As well as in the microelectronics industry, the control of static build-up in workwear is also important in the pharmaceutical and microbiological industries, for three main reasons. Firstly, the build up of an electrostatic charge may cause attraction or repulsion of bacteria or microscopic particles of active pharmaceutical agents, thereby changing the performance of the protective workwear, which may not only serve to protect the product from contamination but also protect the wearer from contact with the materials being handled. The performance of the workwear is therefore closely specified, and the effects of electrostatic attraction or repulsion of materials may be that the performance standard is not achieved in practice. By reducing the electrostatic charge to zero or a very low voltage consistently, the performance of the workwear can be guaranteed. Secondly, the build-up of electrostatic charge can involve a risk of discharge to neighbouring earthed surfaces, giving rise to sparks which can ignite flammable vapours used in processing, for example. The third reason is allied to the second, in that the discharge of high electrostatic voltages through sensitive electronic measuring or monitoring equipment can lead to false readings or to damage. In the context of medical work, false readings or disruption to monitoring equipment could have very serious consequences for patients, for example.

Difficulties can arise in relation to such workwear due to the fact that the conductive filaments are woven into the fabric and as such come to the surface of the fabric relatively infrequently and in an erratic manner. As a result if one piece of fabric is placed on top of another, as occurs, for example in the case of a seam between adjacent parts of an article of workwear, the electrically conductive filaments in each piece of fabric are unlikely to make contact or satisfactory contact with one another with the result that it is unlikely a satisfactory electrical connection will be made across the seam. A similar problem arises in the case of an article of workwear consisting of more than one garment, for example where a hood or an item of footwear are used in association with a main garment. As a result it is difficult to earth all of the garments from a single earthing point.

In U.S. Pat. No. 5,715,536 there is disclosed a static electricity dissipating garment in which a continuous conducting ribbon extends through all the seams and is connected to a grounding wire. Similarly, in U.S. Pat. No. 4,546,497 there is disclosed antistatic clothing incorporating electroconductive tape in the seams. U.S. Pat. No. 4,606,968 discloses a base fabric, for use in antistatic garments, having an integrally woven or knitted grid structure which is raised above the surface of the base fabric to provide increased electrostatic dissipation performance, the grid being formed from a static discharge yarn plied to a carrier yarn which is then woven or knitted into the fabric in the warp direction.

It is therefore known for antistatic workwear to comprise a plurality of components incorporating electrically conductive yarns and an electrically conductive member bridging the junction between adjacent components.

A problem which arises with antistatic workwear is that the antistatic properties tend to degrade with repeated cleaning. For example, workwear may be washed, chemically treated (so-called "dry cleaning") and/or radiation treated to ensure that it is clean and sterile. It has been found that the residual static voltage on the workwear tends to rise with repeated cleaning cycles until it reaches an unacceptable level. For conventional workwear of the types described, it has been found that this state is reached long before the workwear has otherwise come to the end of its working life.

SUMMARY OF THE INVENTION

According to the present invention an article of workwear comprises plurality of components incorporating first electrically conductive yarns, and an electrically conductive member bridging the junction between adjacent components, wherein the electrical conductivity between adjacent components is enhanced by forming the electrically conductive member from a strip or tape incorporating plurality of second electrically conductive yarns which are of larger diameter than said first electrically conductive yarns, portions of the second electrically conductive yarns are exposed along the length of the strip or tape alternately on a first side and a second side of the strip or tape, and the component and conductive member are attached to one another such that the second electrically conductive yarns are in electrically conducting engagement with at least some of the first electrically conductive yarns in both adjacent components, the first electrically conductive yarns are more widely spaced than the second electrically conductive yarns are sharply bent by the structure of the strip or tape to promote a corona discharge.

Throughout the specification and the claims the word "yarn" is used generically to any yarn, fibre, filament or equivalent component of a workwear fabric, strip or tape. At least some of the electrically conductive yarns may be formed from a carbon-coated polyamide or a conductive polyester.

The first electrically conductive yarns in the components preferably have a diameter of between 0.01–0.05 mm, and the second electrically conductive yarns in the strip or tape a diameter of between 0.5–1.0 mm.

The strip or tape is preferably stitched to each of the adjacent components. However, it will be understood that other methods of attachment may be used, for example welding using heat, ultrasonics or high frequency electromagnetic radiation, or adhesives.

Preferably, each component is of woven construction.

The term "component" is used herein to refer both to adjacent components of a single article of workwear and adjacent garments or other items which together form a complete article of workwear. A single article of workwear may, for example, be formed from a number of panels connected together by seams, each of the panels comprising a component of the complete article of workwear. Alternatively an item of workwear may consist of a number of separate articles which are worn together such as a body garment, a hood and articles of footwear, each of which comprises a component of the overall article of workwear.

Where the article of workwear comprises a single garment, the components may comprise adjacent panels from which the garment is constructed and which are connected to one another by seams. In such cases the strip or tape may extend transversely across each seam formed between adjacent components of the article so as to bridge the seam and interconnect electrically conductive members incorporated in the respective panels. Alternatively the strip or tape may be incorporated longitudinally into a seam formed between adjacent components whereby the strip or tape will be in surface contact with each of the panels connected together at the seam.

Where the components comprise a plurality of separate garments employed together to form a complete article of workwear, the strip or tape may incorporate fastening means for interconnecting the separate garments, such fastening means being adapted for engagement with complimentary fastening means on an adjacent article, the respective fastening means being associated with respective strips or tapes bridging a plurality of conductive fibres incorporated in each of the articles to provide electrical continuity. The articles may comprise an upper body or jacket portion of a garment and a lower body or trouser portion. Alternatively, or in addition, the articles may comprise a hood together with an upper body portion or a unitary upper and lower body portion of a garment. In either case the lower body portion of the garment may incorporate integral or separate articles of footwear.

Alternatively, the articles may comprise a complete body garment or a lower body garment and associated articles of footwear, said electrically conductive member extending across the junction of one articles to the other and being connected to or juxtaposed with one or both of the articles.

Alternatively, an electrically conductive member may be associated with each article, the electrically conductive members incorporating complementary fastening members adapted for engagement with one another to secure the articles together and form an electrically conducting path between them. The complementary fastening members may comprise components of a press or stud fastener.

in an alternative arrangement the workwear may comprise an electrically conductive stirrup, opposite ends of which are secured to lower edge regions of leg portions of a garment, the stirrup being adapted to extend beneath the wearer's foot in contact with an article of footwear having an electrically conductive sole. The stirrup member may be located around the wearer's foot internally of the article of footwear whereby to be compressed in use between the wearer's foot and the inner surface of the conductive sole of the article of footwear.

Alternatively, the stirrup member may be arranged to extend around the outer surface of an article of footwear whereby to be compressed in use between the outer surface of the conductive sole of the article of footwear and the floor.

Each strip or tape incorporates a plurality of electrically conductive yarns which may comprise filaments formed from or coated with electrically conductive material. The strip or tape may advantageously be formed from woven polyester fabric incorporating electrically conductive yarns. In a typical construction the electrically conducting yarns in the strip or tape from which the articles are constructed are arranged to form a 5 mm grid pattern, the electrically conducting fibres in the electrically conducting member being arranged in parallel lines approximately 2 mm apart.

It is believed that the use of a strip or tape with conductive elements woven into it in such a way as to protrude from the surface of the strip or tape helps to enhance electrical conductivity in two ways:

1. The protrusions are forced into the fabric of the seam by virtue of the stitching, ensuring physical contact between the electrically conductive elements in the strip or tape and those in the fabric of the component; and 2. The protrusions formed by the sharply bent conductive yarns may promote corona discharge at above about 500 volts, so increasing the rapid conduction of charge across the seams. It is thought that this corona discharge is responsible for the extremely rapid and successful discharge from the made up antistatic workwear.

In addition, antistatic workwear in accordance with the invention has been found to retain its ability to dissipate electrostatic charge after repeated cleaning and sterilisation treatment. For example, workwear subjected to 60 typical wash and wear cycles has shown no significant change in the ability to dissipate charge, and equally workwear subjected to 60 gamma radiation sterilisation cycles also displayed no loss of electrical bonding in the seams. Workwear in accordance with the invention is therefore considerably more economical in use, lasting many more cycles of use and cleaning/sterilisation than conventional antistatic workwear.

BRIEF DESCRIPTION OF THE DRAWINGS

Embodiments of the invention will now be described, by way of example only, with reference to the drawings, which are diagrammatic and in which.

DETAILED DESCRIPTION OF THE ILLUSTRATED EMBODIMENTS

Figure 1:
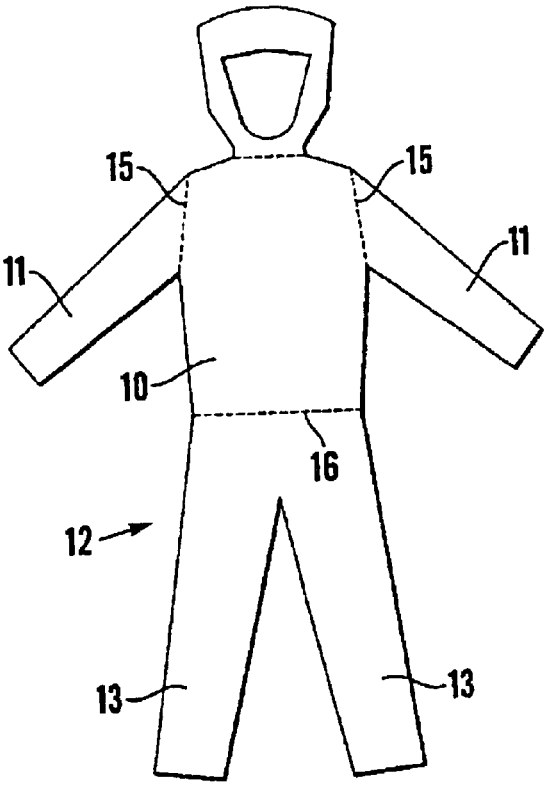
FIG. 1 is an illustration of an article of workwear incorporating one embodiment of the invention.
Figure 2:
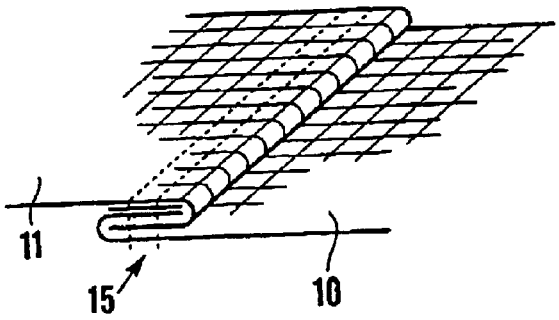
FIG. 2 is a perspective view showing the manner of interconnection of adjacent panels of the garment shown in FIG. 1.
Figure 3:
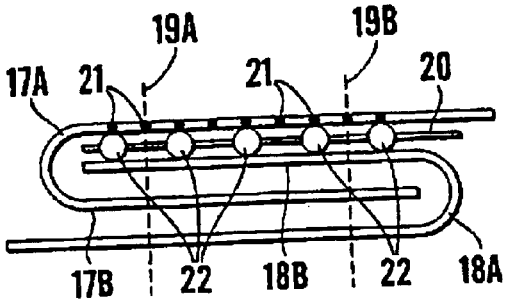
FIG. 3 is an enlarged cross-section through the seam formed between the adjacent panels shown in FIGS. 1 and 2.

Referring to FIGS. 1–3, antistatic workwear comprises an overall having four components, namely a main body component 10, first and second arm components 11 and a trouser or lower body component 12 comprising two leg portions 13. Each of the components is constructed from a woven cleanroom fabric such as continuous filament polyester and incorporates a grid of electrically conductive yarns 21 generally constructed from polyester and carbon and typically spaced apart by intervals of 5 mm or more. This electrically conductive grid defined by the conductive yarns 21 forms a path for localised electrical static charge to be dissipated across the conductive grid.

The main body component 10 is connected to the arm components 11 by seams 15 and to the lower body component 12 by a seam 16. In order to ensure electrical continuity between the components, across the seams 15 and 16, each of the seams incorporates an electrically conductive member defined by a strip or tape 20 of electrically conductive material as best seen in FIGS. 2 and 3. For this purpose the edge regions of each component are folded into generally hook or U-shaped configuration and engaged with one another as shown in FIGS. 2 and 3 so that two layers 17A, 17B of one component and two layers 18A, 18B of the adjacent component overlie one another. A strip or tape 20 of electrically conductive material is located between adjacent portions 17A and 18B of the overlapping components and the assembly secured together by lines of stitching indicated diagrammatically at 19A and 19B. The strip or tape 20 of electrically conducting material is thus clamped between the overlapping portions of the two components and extends longitudinally for the full length of the associated seam 15 or 16.

The strip or tape 20 is formed from polyester fabric incorporating a plurality of electrically conductive yarns 22 formed, for example, from carbon coated nylon or conductive polyester yarns. The conductive yarns 22 are woven through the strip or tape 20 and come frequently to the surface where they are bent around the yarns forming the main portion of the strip or tape 20 and thus project from the surface of the tape, typically by 0.5–1.0 mm. In this way the projecting conductive yarns 22 in the strip or tape 20 are pressed into contact with the conductive yarns in the component 21, thereby enhancing the electrical contact between them. In addition, the relatively sharp bends in the conductive yarns 22 promote corona discharge within the fabric of the component at voltages above about 500V, ensuring transfer of charge even where there is no direct contact between the conductive yarns 21 of the fabric of the component and the conductive yarns 22 in the strip or tape 20.

Figure 4:
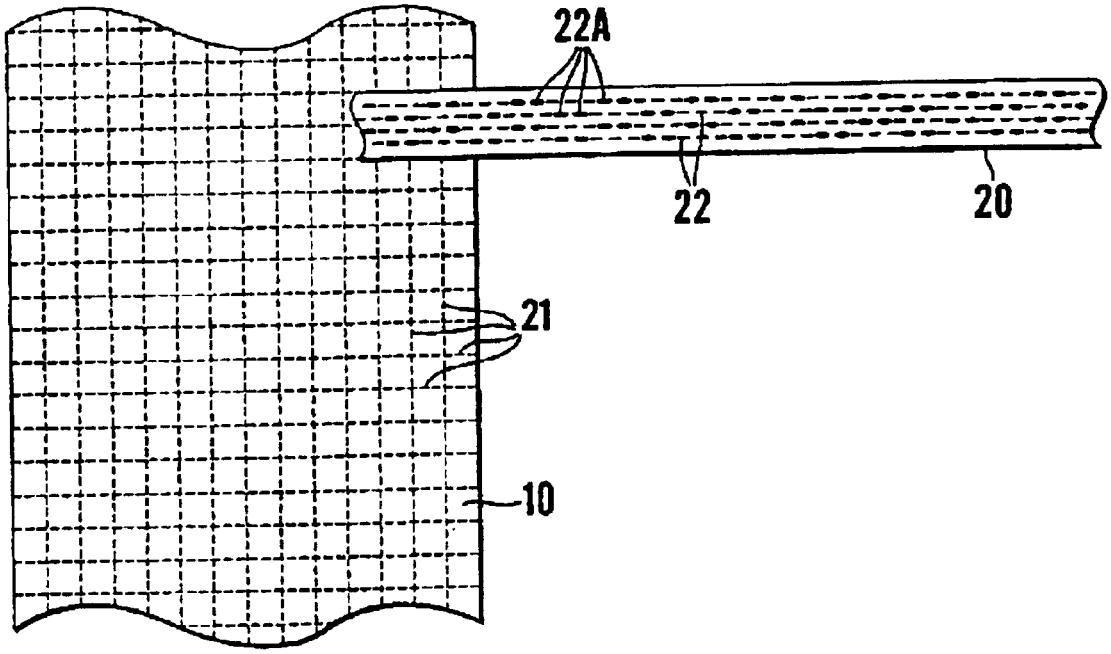
FIG. 4 is an illustration of fabric and tape constructions incorporated in the embodiment of FIGS. 1 to 3.

FIG. 4 shows a component 10 made from a typical garment fabric 10 and strip or tape 20 to scale, the electrically conductive yarns 21 in the component forming a grid of 5 mm mesh size compared with a 2 mm spacing of the electrically conducive yarns 22 of the strip or tape 20. The conductive yarns 22 are exposed at the surface of the tape at the zones 22A indicated by heavy lines in FIG. 4. The conductive yarns 22 are also of larger diameter than the conductive yarns 21, generally being of the order of 0.5–1.0 mm in diameter compared with 0.01–0.05 mm diameter for the conductive yarns 21. By virtue of the close spacing of the conductive yarns 22 compared with the grid size of the conductive yarns 21 and the relatively high degree of exposure of the conductive yarns 22 at the surface of the tape 20, the conductive yarns 22 make contact with a high proportion of the conductive yarns 21 in the overlapping portions 17A, 18B of the adjacent components of the antistatic workwear and provide an effective electrical connection between them. This enables the antistatic workwear to be earthed from a single point since the electrical continuity which exists in the individual components by virtue of the conductive yarns 21 woven into the fabric, is continued across the seams 15 and 16 by virtue of the electrically conductive strip or tape 20 incorporated in the seams.

Figure 5:
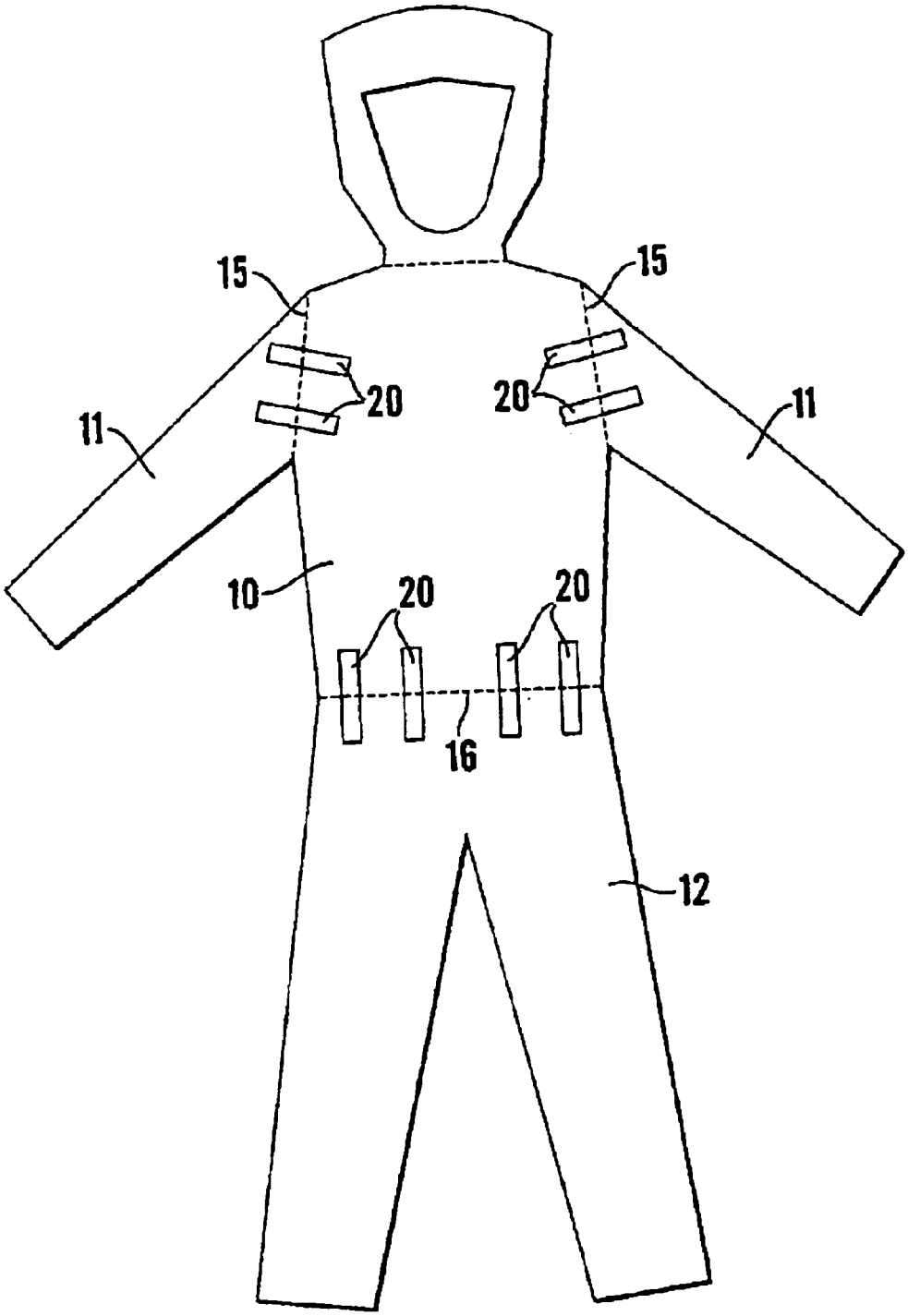
FIGS. 5 and 6 show alternative means of interconnecting the components of a garment similar to that shown in FIG. 1.

FIG. 5 shows an alternative arrangement in which electrical continuity between components 10,11 and 12 of antistatic workwear is maintained across interconnecting seams 15 and 16 by short lengths of electrically conductive strip or tape 20 similar to the strip or tape 20 described with reference to FIGS. 1 to 4. In this embodiment short sections of the strip or tape 20 are arranged to bridge the seams 15 and 16, each section being connected at its opposite ends by sewing or other suitable means to the respective components 10,11 or 10,12. In this way the loss of electrical continuity across the seams is compensated by the electrical "bridges" formed by a plurality of strips or tapes 20. The number of strips or tapes 20 employed may be varied dependent on the spacing of the electrically conductive yarns 21 forming the grid in the fabric of the component, the length of the seams and the measured electrical conductivity across the seams.

Figure 6:
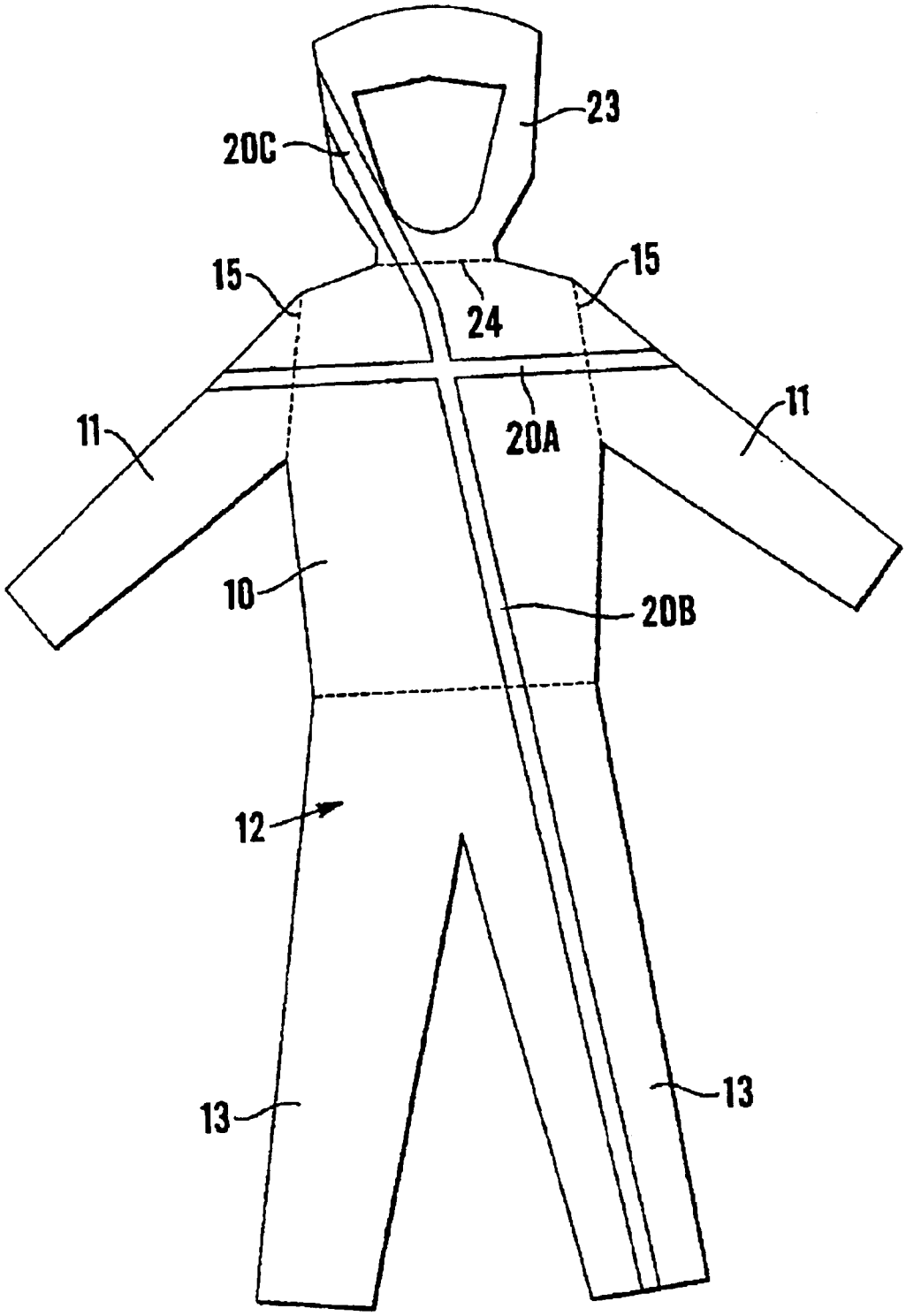

FIG. 6 shows an alternative means of improving electrical conductivity across seams of a unitary article of antistatic workwear in which electrically conductive strip or tape 20, of similar construction to that described with reference to FIGS. 1 to 4, is sewn to the surface of the antistatic workwear and extends across the components from which the garment is constructed. In the embodiment shown in FIG. 6 a first length of strip or tape 20A extends from one arm component 11 across the main body component 10 to the other arm component 11, thereby bridging the seams 15 formed between the main body component 10 and the two arm components 11. A second length of electrically conductive strip or tape 20B extends across the main body component 10 and down one leg portion 13 of the lower body component 12. A strip or tape 20B intersects and is secured to the strip or tape 20A adjacent the upper region of the main body component 10 and thereby provides electrical continuity between the arm components 11, the main body component 10 and the leg portion 13 of the workwear. FIG. 6 also shows an extension 20C of the strip or tape 20B connected to an integral hood portion 23 of the workwear connected to the main body component 10 by a seam 24. In this way electrical continuity is maintained between all the components making up the workwear thereby enabling it to be earthed from a single point.

Figure 7:
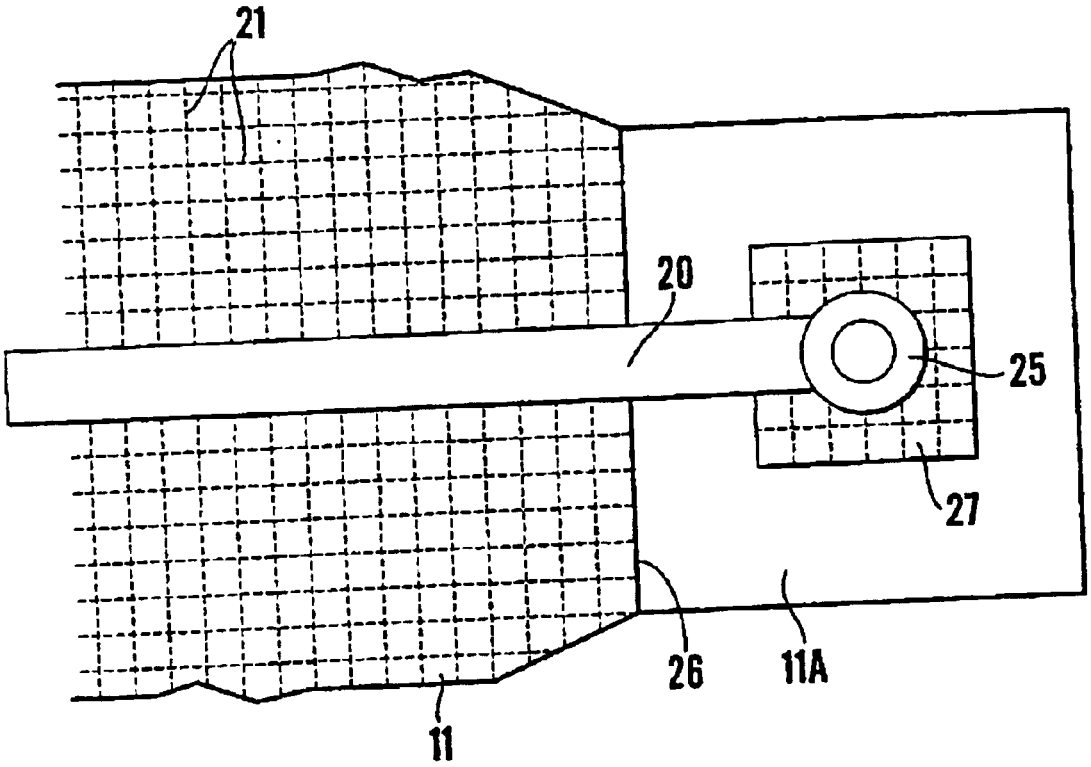
FIG. 7 shows a means of electrically interconnecting a sleeve and cuff of a similar garment.

FIG. 7 shows an embodiment of the invention employed to establish electrical connection between an arm component 11 constructed from fabric incorporating conductive yarns 21 as previously described, and a cuff component 11A. Generally such cuff components are formed from electrically conductive knitted yarns and serve to ensure close contact between the workwear and the wearer's skin. In the arrangement shown in FIG. 7 electrically conductive strip or tape 20, similar to that described above, is sewn onto the arm component 11 and projects beyond the end of the arm component 11 over the cuff component 11A. The strip or tape 20 is connected to a metallic stud-type fastener 25 which is secured to the cuff component 11A and is adapted to form a terminal by means of which the antistatic workwear can be connected to earth. The strip or tape 20 bridges the seam 26 between the arm component 11 and the cuff component 11A thereby maintaining electrical conductivity from the arm component to the cuff component in the manner previously described. The electrical connection between the stud-type fastener 25, the strip or tape 20 and the cuff component 11A may be enhanced, if desired, by attachment of a section of the fabric 27 from which the arm component and the remainder of the workwear is constructed around the area of the stud-type fastener 25. The strip or tape 20 may be relatively short in length as illustrated in FIG. 7 serving simply to bridge the seam 26. Alternatively the strip or tape 20 may comprise a terminal portion of a strip or tape which extends to other parts of the workwear in the manner illustrated, for example, in FIG. 6.

Figure 8:
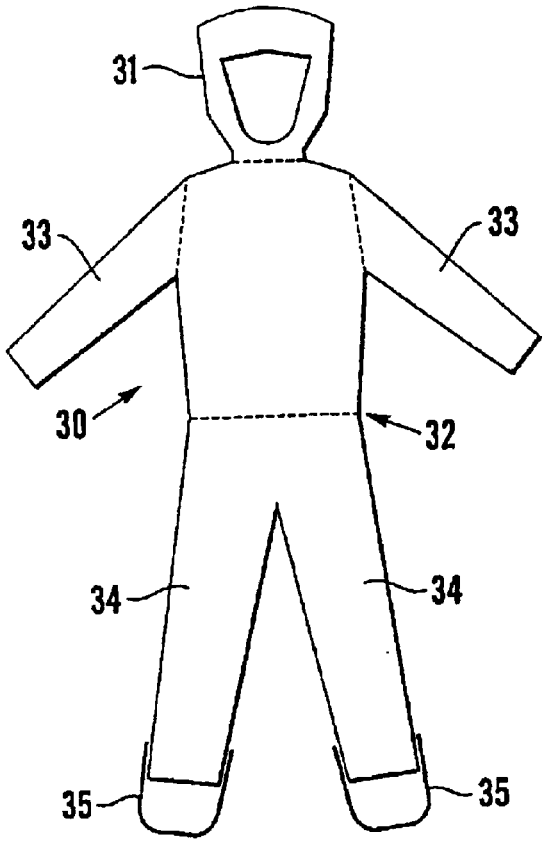
FIG. 8 illustrates a method of interconnecting a garment and articles of footwear according to a further embodiment of the invention.
Figure 9:
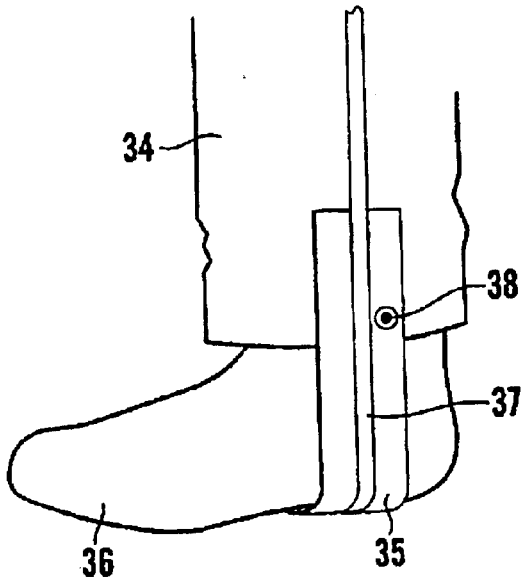
FIG. 9 is an enlarged fragmentary side view of part of the embodiment shown in FIG. 8.

FIGS. 8 and 9 show an alternative arrangement in which electrical continuity is maintained between a one piece item or antistatic workwear 30 and a separate articles of footwear (not shown). As shown in the drawing the item of workwear 30 is of integral one piece construction comprising a hood component 31 and a body component 32 incorporating integral arm components 33 and integral leg portions 34. The item or workwear is constructed from a cleanroom fabric incorporating electrically conductive yarns in the manner previously described and electrical continuity is therefore maintained throughout the item of workwear by virtue of the conductive fibres incorporated in its construction. A stirrup 35 is fitted to the lower end of each leg portion 34 and is formed from similar electrically conductive cleanroom fabric incorporating a grid of conductive yarns. The stirrup is connected at each of its ends to the lower edge of the associated leg portion 34 and is adapted in use to extend under the user's foot 36 and inside a separate articles of footwear (not shown).

In order to enhance electrical conductivity between the item of workwear and the stirrup 35, a strip or tape 37 of electrically conductive material, similar to that described with reference to the previous embodiments, is sewn into the stirrup 35 and projects at opposite ends where it is sewn to the lower region of the leg portion 34. In this way the electrically conductive strip or tape bridges the seams between the stirrup and the associated leg portion 34 and maintains electrical continuity between the conductive grids incorporated in the fabrics from which both components 34 and 35 are formed. A stud 38 may be provided on the stirrup 35 for connection of an ankle earth if required.

The articles of footwear worn by operatives are conventionally provided with electrically conductive soles whereby the operative is earthed to the floor. By virtue of the arrangement described with reference to FIGS. 8 and 9, the operative's workwear is earthed through the conductive sole by virtue of the electrically conductive strip or tape 37 which connects with the main body component of the workwear and the stirrup 35 and thereby enables the entire item or workwear to be earthed from the stirrups 35 fitted to each of the leg portions 34.

While in the arrangement shown in FIGS. 8 and 9 the workwear is illustrated as being of integral construction, in practice it will usually comprise separate components interconnected by seams in the manner described with reference to FIGS. 1 to 6. In that event the components from which the workwear is constructed are preferably interconnected by electrically conductive strip or tape in the manner described with reference to these figures, thereby ensuring electrical continuity is maintained across the seams. Alternatively the workwear may comprise separate hood, body and leg components in which event these are preferably interconnected using electrically conductive strip or tape and suitable fasteners 48A and 48B in the manner to be described with reference to FIGS. 10 to 12 of the drawings, to maintain electrical continuity between the separate components making up the overall item of workwear.

Figure 10:
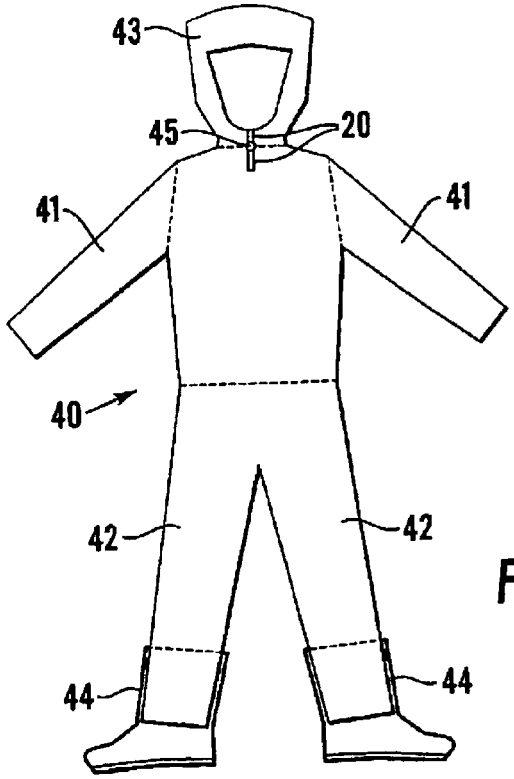
FIG. 10 shows a further method of interconnecting a garment with a hood and with articles of footwear.
Figure 11:
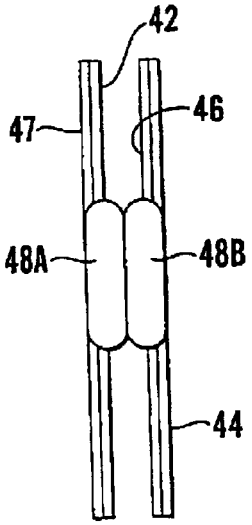
FIG. 11 is an enlarged cross-section showing the manner of interconnection in the arrangement of FIG. 10.
Figure 12:
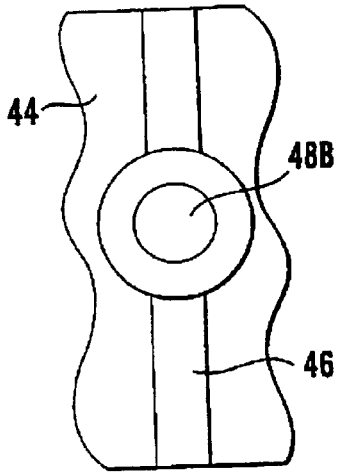
FIG. 12 is a side view of the arrangement shown in FIG. 10.

FIGS. 10 to 12 show a means of maintaining electrical continuity between separate components which together form a complete item of workwear comprising an integral body component 40 incorporating arm components and leg portions 41 and 42, a separate hood component 43 and separate shoes or boots 44 adapted to be fitted over the lower portions of the leg portions 42. The hood component 43 is adapted to overlie the upper region of the body component 40. At the area where the two components overlap, short sections of electrically conductive strip or tape 20, similar to that described with reference to FIGS. 1 to 4, are sewn into the lower edge region of the hood component 43 and the neck region of the body component 40 respectively. Each section of conductive strip or tape is fitted with a respective part of a stud or other suitable fastener 45 which engages the conductive strip or tape which in turn is in contact with the grid of electrically conductive yarns woven into the fabric from which the components are made. Each part of the stud fastener is therefore electrically connected to the associated component and when the workwear is fitted and the stud fasteners interconnected, electrical continuity is effected between the separate components.

The boots 44 are connected to the leg portions 42 of the workwear in a similar fashion. As shown in FIGS. 11 and 12, a strip or tape 46 of electrically conductive material similar to that described with reference to FIGS. 1 to 4, is sewn into an upper region of each boot 44 and a similar strip or tape 47 is sewn on to the adjacent lower region of each leg portion 42. Each section of strip or tape bridges a number of the yarns forming the conductive grid in the fabric from which the boot and body component are formed and respective parts 48A,48B of a stud fastener are fitted to the strip or tape connected to each component When the boot is fitted over the lower end of the leg, the respective parts of the stud fastener are engaged thereby forming electrical continuity between the shoe or boot and the workwear as a whole.

Although not shown in FIG. 10, the arm and body components and the leg portions of the workwear are preferably electrically interconnected across the seams between them by any of the means shown in FIGS. 1, 5 or 6 of the drawings.

By virtue of the arrangements described, electrical continuity may be maintained across seams of a single item of workwear or between separate components forming a complete item of workwear. This enables the workwear to be earthed from a single point, such as from a cuff or ankle, or through an article of footwear in the manner described with reference to FIGS. 7 to 12 of the drawings. The arrangements described are also of simple construction yet provide an effective means of maintaining electrical continuity throughout workwear consisting of multiple interconnected components and/or multiple separate components, thereby enabling static electrical charges to be dissipated without requiring complex multiple earthing arrangements. The construction of the strip or tape is also such that it will withstand repeated exposure to commercial laundering cycles without loss of electrical conductivity.

Figure 13:
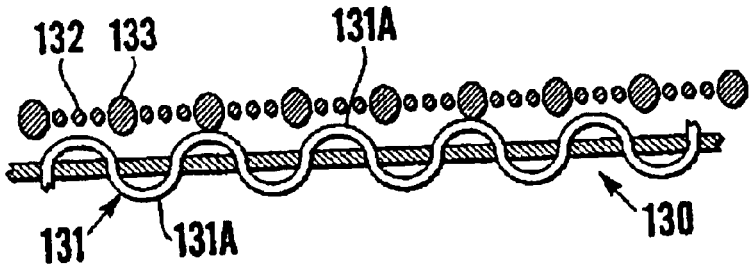
FIG. 13 is an enlarged cross-sectional view of a section of the tape in contact with a piece of the conductive fabric.

FIG. 13 shows, in exaggerated form, the relationship between the conductive yarns in the strip or tape and those in the fabric in a seam. The strip or tape 130 has conductive yarns 131 woven into it in a relatively tight stitch or weave so that the yarns 131 protrude from each face in sharp bends 131A. The fabric of the component is represented by smaller non-conductive yarns 132 and larger conductive yarns 133 spaced therein. It will be appreciated, however, that the relative sizes of the yarns 132 and 133 are not intended to be accurate representations of the relative sizes in reality. The conductive yarns 131 of the strip or tape 130, while being pressed into contact with some of the yarns 133, exhibit sharp bends 131A which pass dose to others of the conductive yarns 133, and the corona discharge effect at the sharp bends ensures that charge is transferred effectively between the conductive yarns 133 of a component of the workwear and the conductive yarns 131 of the strip or tape 130, and from there to the conductive yarns in another component of the workwear, ensuring that any static charge is quickly dissipated through the workwear to the earthing point, for example the floor, through conductive shoe soles, for example.

Various modifications may be made without departing from the invention. For example the invention may be applied to a wide range of workwear consisting of multiple separate components or incorporating seams in a variety of different locations. The fabric from which the workwear is constructed may vary as regards its material and the nature and extent of the electrically conductive yarns incorporated in it For example while such conductive yarns are normally incorporated in a grid formation, they may alternatively be incorporated in the form of stripes. The electrically conducting strip or tape employed in the embodiments may be constructed in a wide variety of alternative forms provided it has a substantial electrically conductive surface area adapted to bridge a plurality of the conductive yarns incorporated in the fabric from which the components of the workwear are constructed to thereby maintain electrical continuity throughout the item of workwear. The strip or tape may also be secured to the inside or outside surfaces of the components by sewing or other suitable means.

Moreover, while reference has been made herein primarily to effecting electrical continuity between components of items of workwear, the invention may also be applied to other situations where it is necessary to maintain electrical continuity across seams, joins or other areas where a break in electrical continuity would otherwise occur.

What is claimed is:

1. Antistatic workwear comprising a plurality of components incorporating first electrically conductive yarns, and an electrically conductive member bridging the junction between adjacent components, wherein the electrical conductivity between adjacent components is enhanced by forming the electrically conductive member from a strip or tape incorporating a plurality of second electrically conductive yarns which are of larger diameter than said first electrically conductive yarns, portions of the second electrically conductive yarns are exposed along the length of the strip or tape alternately on a first side and a second side of the strip or tape, and the component and conductive member are attached to one another such that the second electrically conductive yarns are urged into in electrically conducting engagement with at least some of the first electrically conductive yarns in both adjacent components, the first electrically conductive yarns are more widely spaced than the second electrically conductive yarns, and the second electrically conductive yarns are sharply bent by the structure of the strip or tape to promote a corona discharge.

2. Antistatic workwear, according to claim 1, in which the first electrically conductive yarns have a diameter of between 0.01–0.05 mm.

3. Antistatic workwear, according to claim 1, in which the second electrically conductive yarns have a diameter of between 0.5–1.0 mm.

4. Antistatic workwear, according to claim 1, in which the strip or tape is connected to each of the adjacent components by stitching.

5. Antistatic workwear, according to claim 1, in which at least some of the first and second electrically conductive yarns are formed from a carbon-coated polyamide or a conductive polyester.

6. Antistatic workwear, according to claim 1, in which the strip or tape is incorporated longitudinally into a seam formed between adjacent components.

7. Antistatic workwear, according to claim 1, in which the strip or tape extends transversely of a seam formed between adjacent components.

8. Antistatic workwear, according to claim 7, in which a plurality of strips or tapes extend transversely across the same seam.

9. Antistatic workwear, according to claim 1, in which at least one strip or tape is connected to a terminal for connecting the workwear to ground.

10. Antistatic workwear, according to claim 1, which includes a component defining a leg portion of the workwear and a boot defining another portion of the workwear, and the boot is connected to the component by a fastener to provide electrical continuity.

11. Antistatic workwear, according to claim 1, in which the components comprise a plurality of separable components, and the strips of tapes incorporate fastening means for interconnecting the separable components to provide electrical continuity.

12. Antistatic workwear, according to claim 1, in which one or more of the strips or tapes provide an electrically conducting path extending from a cuff to boots.

13. Antistatic workwear, according to claim 1, having a leg portion arranged in conducting engagement with an electrically conductive stirrup arranged to extend beneath the wearer's foot in electrical contact with an article of footwear having a conductive sole.

* * * * *